US006314938B1

(12) United States Patent
McCreery et al.

(10) Patent No.: US 6,314,938 B1
(45) **Date of Patent: *Nov. 13, 2001**

(54) STARTING SYSTEM FOR SPARK IGNITION ENGINE

(75) Inventors: Patrick A. McCreery, Charlotte, NC (US); Jack Eric Campbell, Fort Mill; Charles Gaymon, Rock Hill, both of SC (US)

(73) Assignee: Deere & Company, Charlotte, NC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/178,994

(22) Filed: Oct. 26, 1998

(51) Int. Cl.[7] ..... F02N 3/02

(52) U.S. Cl. ..... 123/406.56; 123/149 D; 123/179.5; 123/185.3

(58) Field of Search ..... 123/406.56, 406.57, 123/179.5, 185.2, 185.3, 185.4, 149 D

(56) References Cited

U.S. PATENT DOCUMENTS

| | | | | |
|---|---|---|---|---|
| 2,841,629 | | 7/1958 | Autrey | 123/148 |
| 3,874,354 | | 4/1975 | Crouch | 123/148 |
| 4,114,583 | * | 9/1978 | Sleder et al. | 123/406.57 |
| 4,163,437 | * | 8/1979 | Notaras et al. | 123/149 D |
| 4,345,575 | | 8/1982 | Jorgensen | 123/598 |
| 4,610,231 | | 9/1986 | Nakata et al. | 123/424 |
| 4,817,577 | | 4/1989 | Dykstra | 123/651 |
| 5,361,738 | * | 11/1994 | Iida | 123/185.4 |
| 5,377,642 | | 1/1995 | Morrow et al. | 123/182.1 |
| 5,600,195 | | 2/1997 | Welborn et al. | 310/153 |
| 5,630,384 | | 5/1997 | Mottier et al. | 123/149 |
| 5,816,221 | | 10/1998 | Krueger | 123/491 |

FOREIGN PATENT DOCUMENTS 2-108855 * 4/1990 (JP) .

OTHER PUBLICATIONS

Patent Abstracts of Japan, Publication No. 56162947, Dec. 15, 1991, one page, Application No. JP 55065244, "Flywheel Magnet", Takamiki.

Patent Abstracts of Japan, Publication No. 54057039, May 8, 1979, one page, Application No. JP 52123315, "Manual Starter", Toshiro.

Homelite Parts List 1998 John Deere Consumer Products, Inc. (17pgs.)

* cited by examiner

*Primary Examiner*—Andrew M. Dolinar
(74) *Attorney, Agent, or Firm*—Perman & Green, LLP

(57) ABSTRACT

A starting system for a manual only pull start internal combustion engine with a starting pulley, a pull cord wrapped around the starting pulley, a rotor selectively engageable with the starting pulley, and an ignition module located adjacent to rotor. The starting pulley has a pull cord groove with an enlarged diameter between about 2.5 to 3.4 inches. The ignition module is adapted to fire a spark plug of the engine with a timing retard of about 8 degrees at a speed of about 500 rpm of the rotor.

7 Claims, 5 Drawing Sheets

STARTING SYSTEM FOR SPARK IGNITION ENGINE

BACKGROUND OF THE INVENTION

1. Field of the Invention

The present invention relates to internal combustion engines and, more particularly, to a starting system for a pull start engine.

2. Prior Art

Pull start internal combustion engines are well known in the art. These manual pull start engines have a starting pulley and a pull cord that is wrapped around the starting pulley in a groove. The diameter of the groove cannot be too large otherwise the pulley will not be able to turn the rotor of the engine fast enough to cause the engine to start.

SUMMARY OF THE INVENTION

In accordance with one embodiment of the present invention a starting system for an internal combustion engine is provided having a starting pulley with a pull cord groove, a pull cord wrapped around the starting pulley in the pull cord groove, a rotor selectively engageable with the starting pulley, and an ignition module located adjacent the rotor and connected to a spark plug of the engine. The ignition module is adapted to produce an ignition voltage high enough to fire the spark plug with a timing retard of about eight degrees at a speed of about 500 rpm of the rotor. The pull cord groove has a diameter between about 2.5 to 3.4 inches.

In accordance with another embodiment of the present invention a starting system for an internal combustion engine is provided having a starting pulley, a pull cord wrapped around the starting pulley, a rotor selectively engageable with the starting pulley, and an ignition module located adjacent the rotor and connected to a spark plug of the engine. The starting system further comprises means for reducing pull cord speed to start the engine without increased engine kickback comprising the starting pulley having an enlarged diameter pull cord groove, and the ignition module being adapted to produce an ignition voltage high enough to fire the spark plug of the engine at a low rotor rotational speed of about 500 rpm.

In accordance with one method of the present invention a method of starting an internal combustion engine is provided comprising steps of pulling a starter pull cord of the engine with a speed of about 5.5 feet per second; and rotating a rotor of the engine at a speed of about 500 rpm while the pull cord is being pulled at about 5.5 feet per second. The engine has an ignition module adapted to produce an ignition voltage high enough to fire a spark plug of the engine at the minimum start speed of the rotor.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
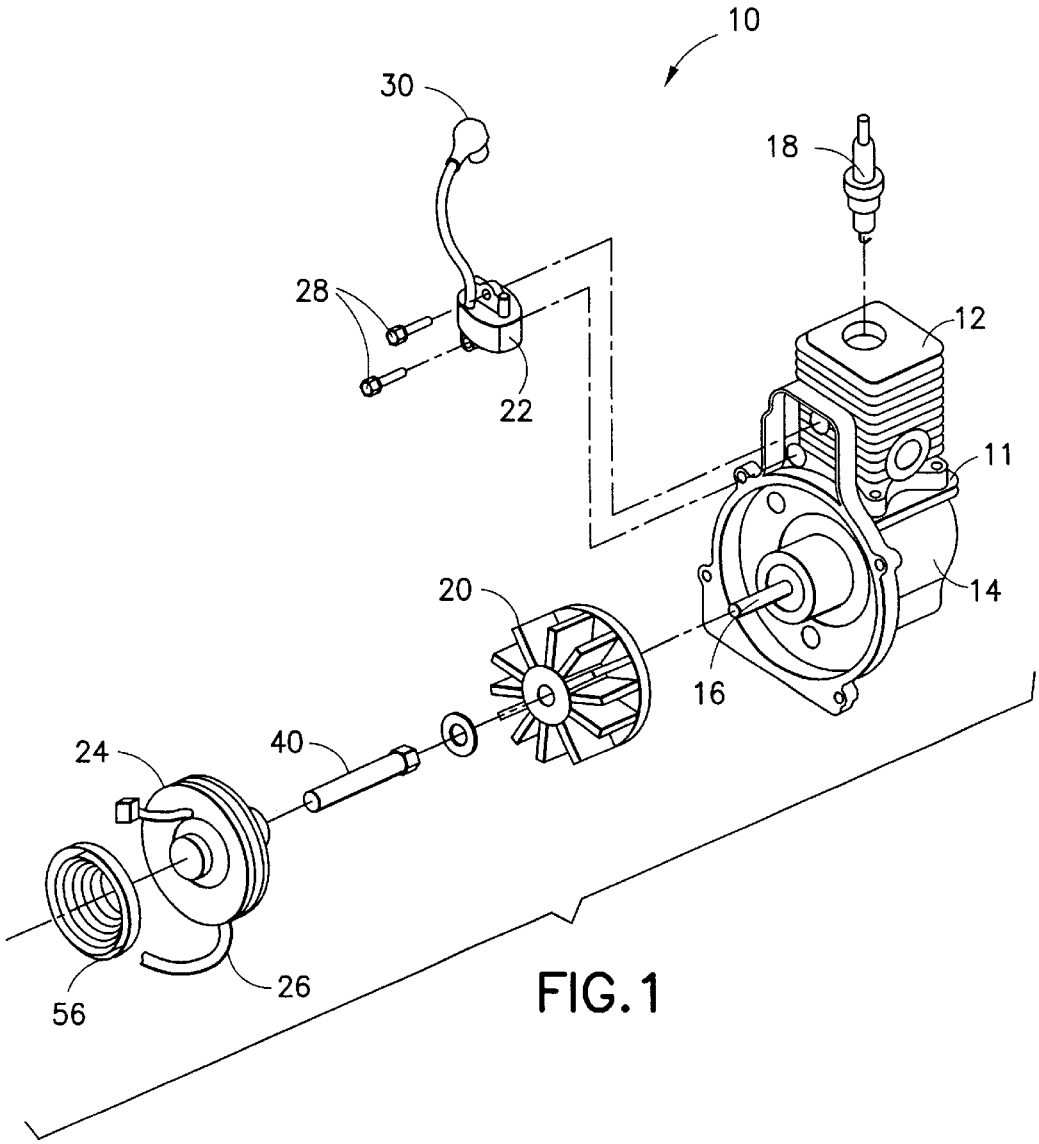
FIG. 1 is an exploded perspective view of an internal combustion engine incorporating features of the present invention.

Referring to FIG. 1, there is shown a partial exploded perspective view of an internal combustion engine 10 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

Figure 2:
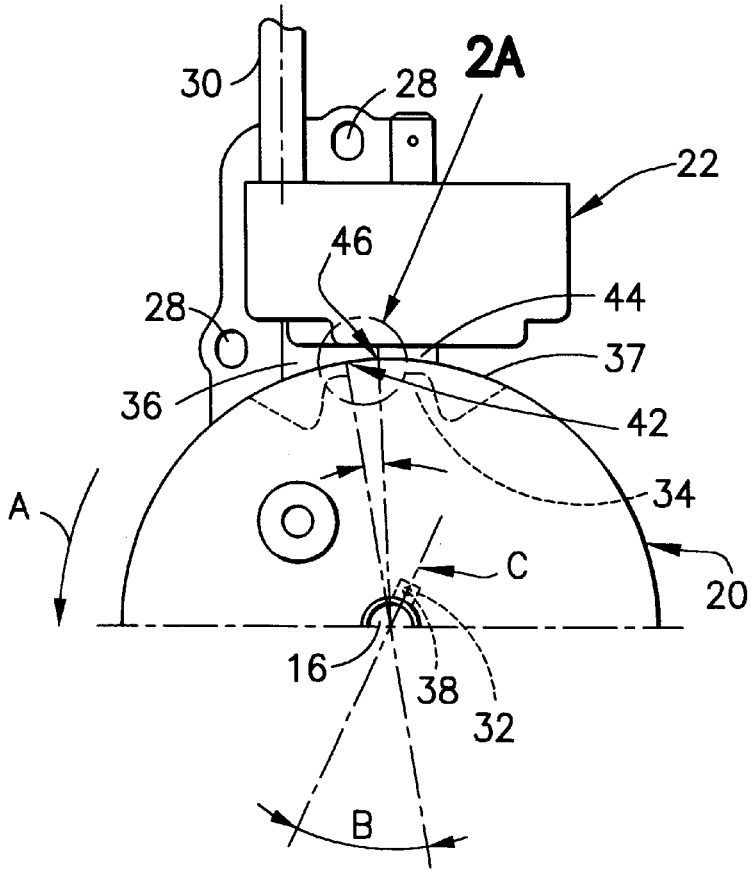
FIG. 2 is a partial schematic view of the rotor and ignition module of the engine shown in FIG. 1.
Figure 2A:
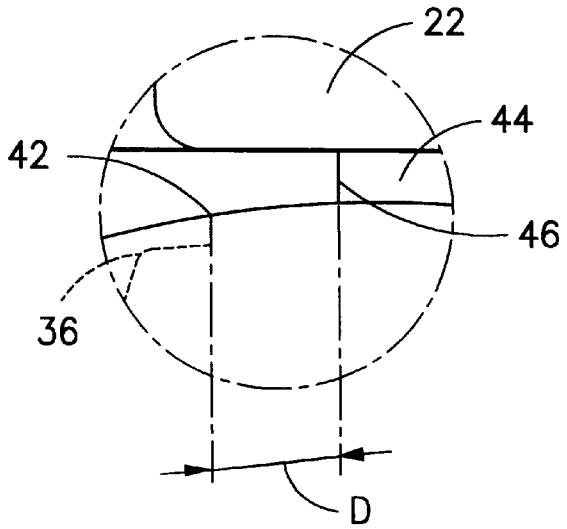
FIG. 2A is an enlarged view of area 2A shown in FIG. 2.

The engine 10 generally comprises a frame 11 having a cylinder 12 and a crankcase 14, a crankshaft 16, a spark plug 18, a rotor 20, an ignition module 22, and a starting pulley 24. The engine 10 is a manual only pull start engine with a pull cord 26 adapted to be pulled by a user. In this embodiment the engine is a two-cycle single cylinder engine such as used in a string trimmer, hedge trimmer, leaf blower or other types of power tool. However, features of the present invention could be used on other types of engines, such as a four-cycle engine or multi-cylinder engines. The ignition module 22 is attached to the frame 11 by fasteners 28. An electrical wire terminal and cover 30 extend from the module 22 to the outer end of the spark plug 18. Referring also to FIG. 2, the rotor 20 is fixedly mounted on the shaft section of the crankshaft 16. The rotor 20 has a keyway 32 and a magnet 34 with two pole shoes 36, 37. The shaft section of the crankshaft 16 has a key 38 that mates with the keyway 32. The rotor 20 and crankshaft 16 rotate together as indicated by arrow A. A connector 40 screws onto the crankshaft 16 to lock the rotor 20 on the crankshaft 16. The centerline C of the keyway 32 is angled relative to a trailing edge 42 of the leading pole shoe at an angle B. In a preferred embodiment, the centerline of the keyway is aligned with the piston head at top dead center. Preferably the angle B is about 42 degrees. However, in alternate embodiments other angles could be provided, such as about 35 degrees. The ignition module 22 is mounted to the frame 11 adjacent the rotor 20. The module 22 has a center core leg 44 to magnetically interact with the pole shoes 36, 37. In a preferred embodiment the ignition module 22 is a Walbro module MA-12 manufactured by Walbro Engine Manufacturing Corp. of Cass City, Mich. The MA-12 module has the following performance specifications at 25° C.:

| MINIMUM | | | TYPICAL | | | | |
|---|---|---|---|---|---|---|---|
| Rotor Speed (R.P.M.) | Open Circuit (K.V.) | .5 Meg. Ohm Load (K.V.) | Open Circuit (K.V.) | .5 Meg. OHM Load (K.V.) | Spark Duratio n* | Timing ** | Spark Energy *** |
| 500 | 7.5 | 6.0 | 9.5 | 7.8 | | −8.0 | |
| 700 | 11.0 | 9.5 | 15.0 | 12.3 | | −5.0 | |
| 1000 | 15.5 | 12.3 | 19.0 | 15.5 | | −4.0 | |
| 1500 | 18.0 | 15.0 | 22.0 | 18.3 | 85 | −2.5 | 1.7 |
| 2000 | 19.5 | 16.5 | 24.0 | 19.4 | 87 | −1.0 | 1.7 |
| 3000 | 20.0 | 17.0 | 24.0 | 20.0 | 88 | −0.5 | 1.7 |
| 6000 | 19.5 | 16.0 | 22.0 | 18.5 | 89 | 0.0 | 1.7 |
| 8000 | 18.0 | 15.0 | 21.0 | 17.5 | 89 | 0.0 | 1.7 |
| 10000 | 17.0 | 14.0 | 20.0 | 16.0 | 87 | −0.5 | 1.6 |
| 12000 | 16.5 | 13.5 | 19.0 | 16.0 | 87 | −1.5 | 1.5 |

* FIRING A 10 K.V. GAP (MICRO SECONDS)
** USING 8000 R.P.M. AS 0° REFERENCE
*** FIRING A 10 K.V. GAP (milli-Joules)

The cut-in speed of the rotor for spark ignition is between about 400–700 rpm with a typical rise time of about 3 microseconds. The edge distance D between the trailing edge 42 of the leading pole shoe 36 and the trailing edge 46 of the core by 44 is about 6.25 mm at 8000 rpm. The Walbro module MA-12 is used in an electric start engine on a string trimmer, manufactured by John Deere Consumer Products Inc., of Charlotte, N.C., but has not been used on a manual-only pull start engine.

Figure 3:
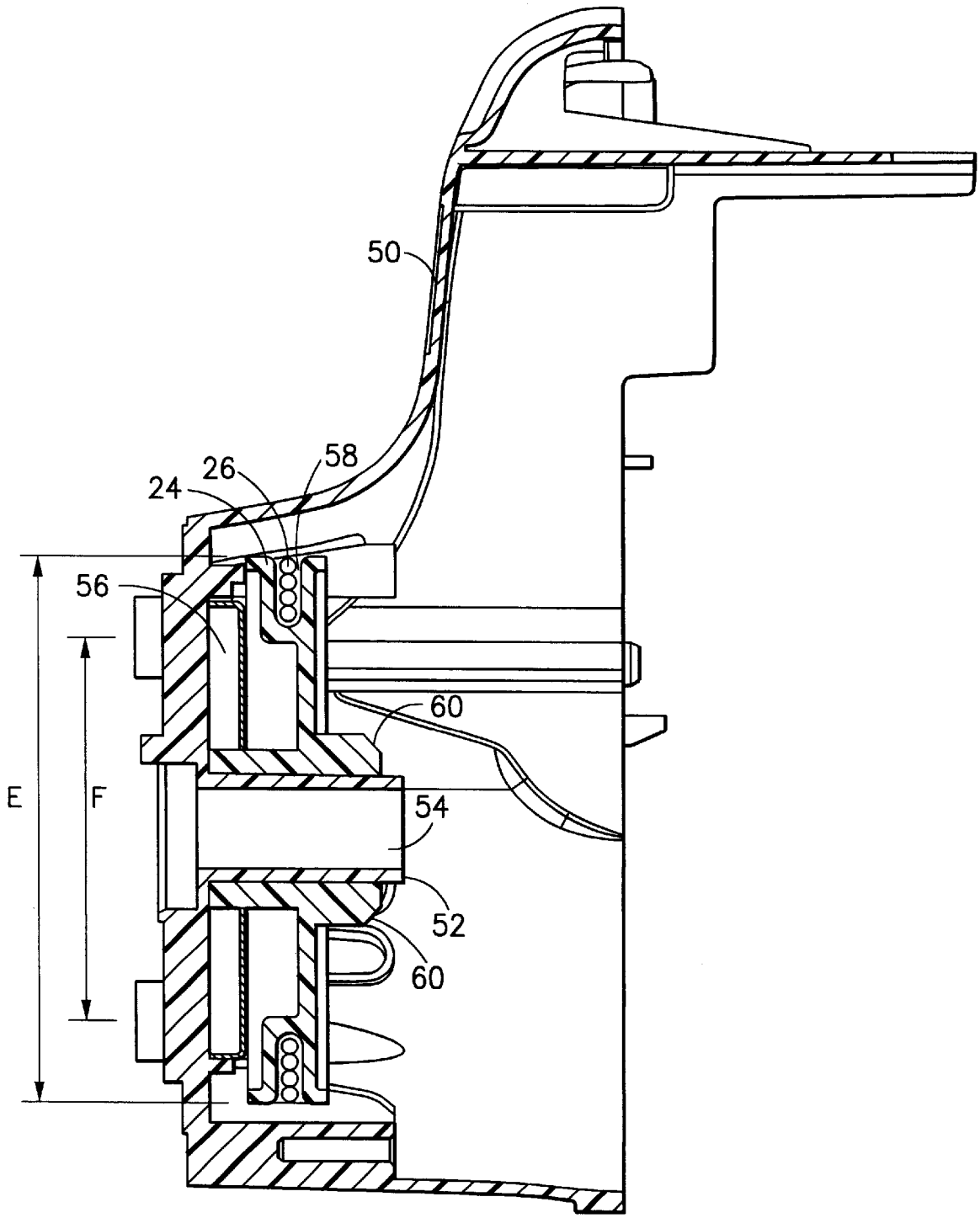
FIG. 3 is a cross-sectional view of the starting pulley and spring assembly mounted on a housing piece for the engine shown in FIG. 1.

Referring also to FIG. 3, the engine 10 has a housing piece 50 which is attached to the frame 11 over the rotor 20. The housing piece 50 has a mount 52. The mount 52 has a hole 54 which allows the connector 40 to pass through the housing piece 50. The mount 52 also rotatably supports the starting pulley 24 thereon. The starting system also has a spring and container assembly 56 sandwiched between the starting pulley 24 and the housing piece 50. The assembly 56 biases the starting pulley 24 at a home position relative to the housing piece 50. The starting pulley 24 includes a pull cord groove 58 and starter pawl latching teeth 60. The pull cord 26 is wrapped around the pulley 24 in the groove 58 and extends out a hole (not shown) in the housing piece 50 where it is attached to a pull handle (not shown). The groove 58 has an outer diameter E and an inner diameter F. In a preferred embodiment E is about 3.375 or 3.4 inches and F is about 2.5 inches. By comparison, E is only about 2.6 inches and F is about 1.5 inches in a known prior art starting pulley. Thus, the pulley 24 has an enlarged diameter pull cord groove 58 compared to the prior art. As used herein the term "enlarged diameter pull cord groove" is intended to mean an outer diameter or perimeter of the pull cord groove being greater than 2.7 inches. The teeth 60 are adapted to selectively engage spring biased starter pawls on the rotor. One such rotor is described in U.S. Pat. No. 5,600,195 which is hereby incorporated by reference in its entirety. When the pull handle (not shown) is pulled by a user to start the engine this pulls the pull cord 26. Because the pull cord is attached to the pulley 24, the pulley is rotated on the mount 52. Because the teeth 60 engage starter pawls on the rotor 20, the rotor 20 is rotated with the pulley 24 (at least until the engine starts and the starter pawls are moved outward by centrifugal force). The increased diameter groove 58 significantly reduces the effort of a user when pulling the pull cord to start the engine since the larger diameter pulley provides a greater mechanical advantage with which to turn the engine than with the prior art smaller diameter pulley.

However, there is a problem with using a larger diameter starting pulley. A larger diameter starting pulley, if used on a prior art engine, will not turn the engine fast enough to cause a standard prior art manual pull start ignition module to fire and, hence, the engine will not start. Even if such a manual pull start prior art ignition module were to fire at low speed, a high kickback would most certainly occur. To overcome this problem the present invention uses the module 22 which is adapted to fire the spark plug at low rotor speeds, such as 400–700 rpm, and which has a timing retard at low speeds to prevent kickback. The use of the module 22 alone does not do much to improve starting ability of the engine. Instead, it is the combination of the module 22 with the increased diameter starting pulley 24 that significantly improves starting of the engine. The combination allows less force to be used in pulling the pull cord to start the engine. The combination allows the pull cord to be pulled at a slower speed than in the prior art to start the engine. The combination makes pulling of the pull cord feel smoother to the user and has virtually no kickback.

These improved starting characteristics are the result of several things working together. First, the module has two desirable features. One, it will produce ignition voltage high enough to fire the plug when the rotor is turning at a relatively low speed (approximately 500 rpm). Two, the module has a timing retard at low speed (approximately 8 degrees at about 500 rpm) which fires the spark plug closer to top dead center (TDC); thus minimizing kickback. The above two features make the use of a larger diameter starting pulley possible. With an outer diameter of the groove being about 3.375 inches and a cut-in start speed of about 410 rpm necessary to start the engine, the pull cord only has to be pulled at about 6 ft/sec. To start the engine. In the prior art engine, on the other hand, with an outer diameter of the groove being about 2.6 inches and a cut-in start speed of about 640 rpm necessary to start the engine, the pull cord needed to be pulled at about 7.26 ft/sec. Thus, with the present invention the pull cord can be pulled over one foot per second slower than in the prior art to start the engine.

Figure 4:
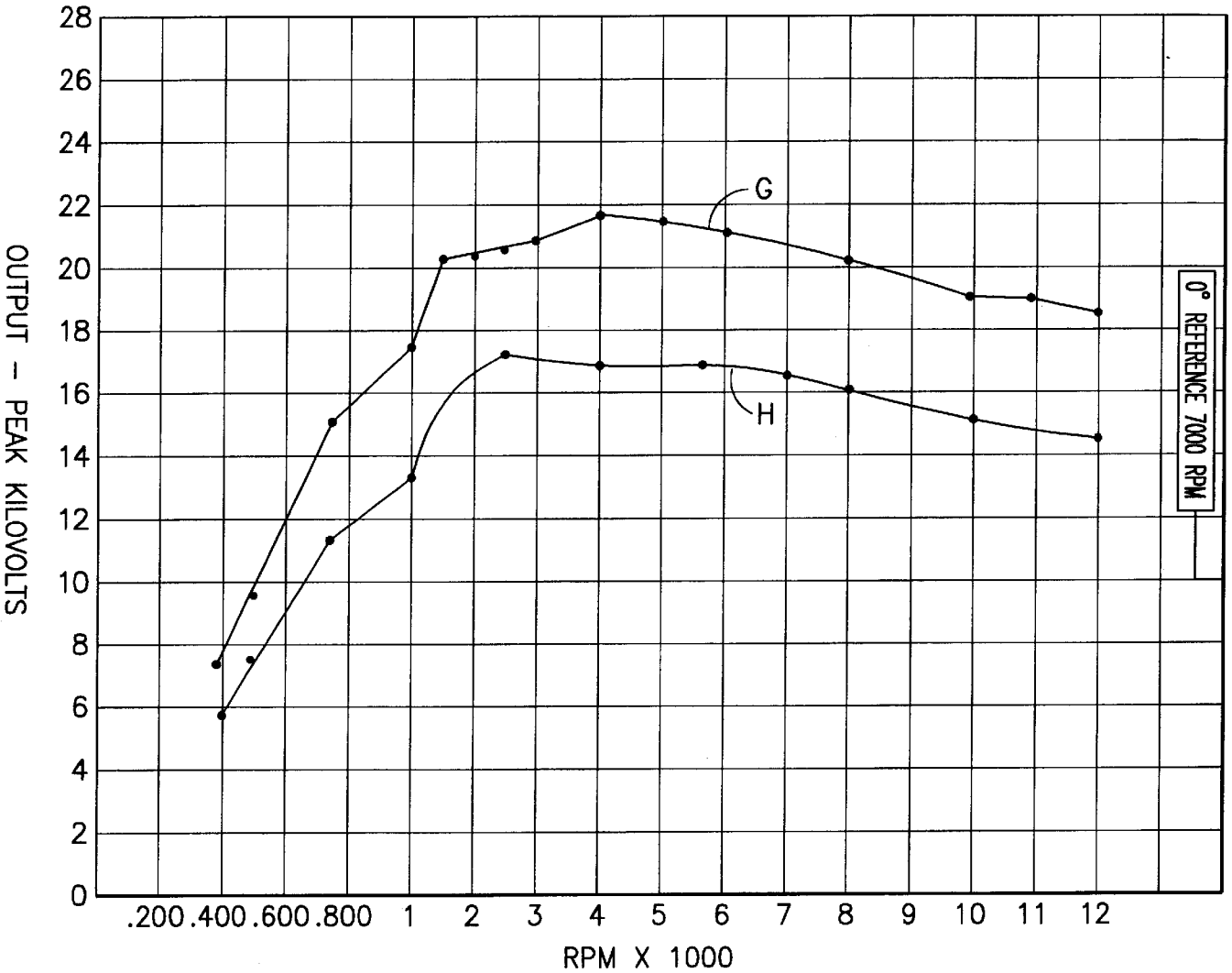
FIG. 4 is a graph of ignition module output versus engine speed for the engine shown in FIG. 1 for an unshunted condition and s shunted condition.
Figure 5:
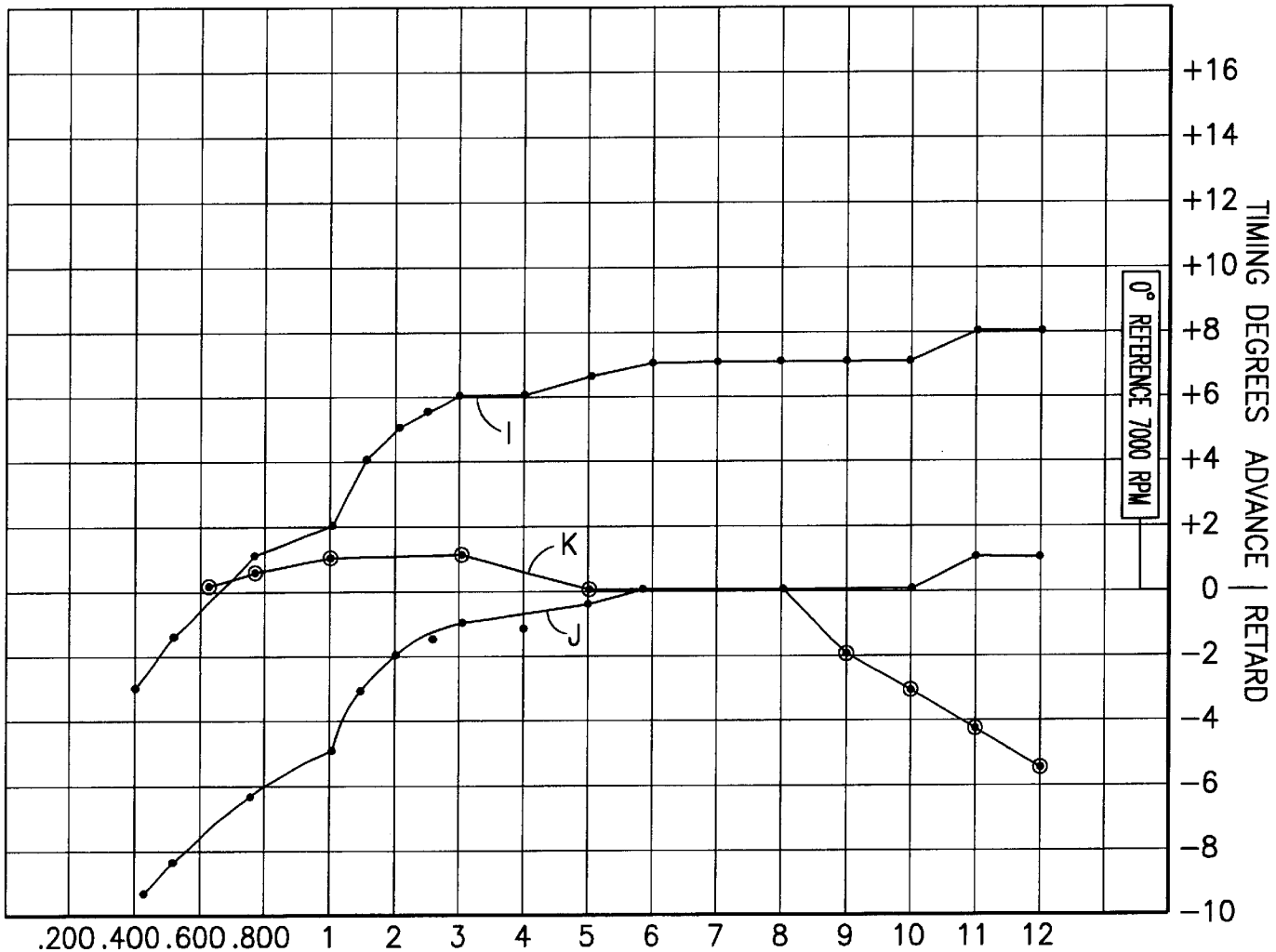
FIG. 5 is a graph of ignition module timing for various ignition modules.

Referring also to FIG. 4, a graph is shown of output of the module 22 relative to cut-in speed of the rotor 20 from test measurements for both OC in kilovolts shown in line G and a shunted output through a 0.5 Meg. Ohm load shown in line H. To further improve starting characteristics the keyway 32 on the rotor 20 can be moved. In a standard known prior art rotor the keyway angle B (see FIG. 2) is about 35°. Referring also to FIG. 5 test results for timing for such a prior art rotor is shown on line I with a 10 kilovolt timing gap. The 7 degree timing advance at 7000 rpm still allows detonation of the fuel in the cylinder and timing retard and cut-in speed are lower than in the prior art engine having the same rotor as shown by line K. Line J, on the other hand, has the rotor with keyway angle B at about 42°. This graph was produced from the following test measurements:

| Cut-In Speed (RPM) | Timing for Prior Art Rotor and Prior Art Ignition Module | Timing for Ignition Module (22) and Prior Art Rotor (35° Angle B) | Timing for ignition Module (22) and Rotor (20) (42° Angle B) |
|---|---|---|---|
| 410 | N/A | −3 | −9.5 |
| 500 | N/A | −1.5 | −8.5 |
| 640 | −1.0 | — | — |
| 750 | −0.5 | 1.0 | −6.5 |
| 1000 | −0.5 | 2.0 | −5.0 |
| 1500 | −0.5 | 4.0 | −3.0 |
| 2000 | −0.5 | 5.0 | −2.0 |
| 2500 | −0.5 | 5.5 | −1.5 |
| 3000 | −0.5 | 6.0 | −1.0 |
| 4000 | −1.0 | 6.0 | −1.0 |
| 5000 | −1.0 | 6.5 | −0.5 |
| 6000 | −1.0 | 7.0 | 0.0 |
| 7000 | 0.0 | 7.0 | 0.0 |
| 8000 | 0.0 | 7.0 | 0.0 |
| 9000 | −2.0 | 7.0 | 0.0 |
| 10000 | −3.5 | 7.0 | 0.0 |
| 11000 | −5.0 | 8.0 | 1.0 |
| 12000 | −6.0 | 8.0 | 1.0 |

AS seen from line J, the timing retard at low speed is much greater, thus reducing kickback at low speed and less timing retard or advance at high speed. The rotor 20 having the keyway angle B at 42° allows the rotor and module setup to have comparative timing of 0 degrees at 7000 rpm and about −8 degrees at 500 rpm referenced to 0 degrees at 7000 rpm. The prior art, as shown in line K, had 0 degrees at 7000 rpm and about 0 degrees at about 600 rpm referenced to 0 degrees at 7000 rpm. In another example, the ignition module could provide a timing retard of about 9 degrees at the rotor speed of about 500 rpm. The module 22 allows for a slower pull start and, no matter how slowly the pull cord is pulled, there is no kickback possible. Idle was smooth down to 2000 rpm with the engine stalling at about 1600 rpm (the speed at which the starter pawls start to re-engage with the starting pulley). A further advantage was found by adding exhaust port compression release, such as disclosed in U.S. Pat. No. 5,377,642 which is hereby incorporated by reference in its entirety. Compression release allowed the engine to start with an extremely gentle and slow pull of the pull cord with no kickback. In fact, the engine could be started by pulling the pull cord with one little finger on a user's hand. Idle was smooth down to 1800 rpm with the unit stalling at about 1200 rpm. Because the idle speed with the present invention can be as low as 1800 rpm versus about 2500–3000 rpm idle speed in the prior art, noise levels are reduced at idle speed versus the prior art engine.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. In a two-cycle internal combustion engine comprising a single cylinder, a single spark plug connected to the cylinder, a crankshaft, and a starting system connected to the crankshaft, the starting system having a starting pulley, a pull cord wrapped around the starting pulley, a rotor selectively engageable with the starting pulley, and an ignition module located adjacent the rotor and connected to a spark plug of the engine, wherein the improvement comprises:

means for providing a reduced pull cord speed to start the engine comprising the starting pulley having an enlarged diameter pull cord groove, and the ignition module being adapted to produce an ignition voltage high enough to fire the spark plug of the engine at a low rotor rotational speed of about 500 rpm or less, wherein the enlarged diameter pull cord groove has an inner diameter of about 2.5 inches and an outer diameter of about 3.4 inches.

2. A two-cycle engine as in claim 1 wherein the ignition module provides a timing retard of about 9 degrees at the rotor speed of about 500 rpm.

3. A two-cycle engine as in claim 2 wherein the ignition module provides no timing retard at a rotor speed of about 7000 rpm.

4. A two-cycle engine as in claim 1 wherein the ignition voltage is about 7 kilovolts.

5. A two-cycle engine as in claim 1 wherein the engine comprises a compression release hole through a cylinder of the engine.

6. A two-cycle engine as in claim 1 wherein the rotor has a keyway at an angle of about 42 degrees relative to a trailing edge of a leading pole shoe of the rotor.

7. A two-cycle engine as in claim 1 wherein the ignition module provides a timing retard of at least about 8 degrees.

* * * * *